United States Patent [19]

Steudten et al.

[11] 4,211,040

[45] Jul. 8, 1980

[54] PROCESS FOR MACHINING SILICON RODS AND TUBES BY ABRASION

[75] Inventors: Friedrich Steudten, Burghausen; Franz Köppl, Altotting, both of Fed. Rep. of Germany

[73] Assignee: Wacker-Chemitronic Gesellschaft für Elektronik-Grundstoffe mbH, Burghausen, Fed. Rep. of Germany

[21] Appl. No.: 955,429

[22] Filed: Oct. 27, 1978

[30] Foreign Application Priority Data

Dec. 30, 1977 [DE] Fed. Rep. of Germany ..... 2758887

[51] Int. Cl.[2] ..... B24B 5/04

[52] U.S. Cl. ..... 51/42; 51/49; 51/89

[58] Field of Search ..... 51/3, 42, 49, 50 R, 51/89, 289 R, 290; 409/203

[56] References Cited

U.S. PATENT DOCUMENTS

| | | | |
|---|---|---|---|
| 157,744 | 12/1874 | Elliott | 51/42 |
| 1,288,283 | 12/1918 | Taylor | 409/203 X |
| 1,831,085 | 11/1931 | Williams | 51/50 R |
| 2,231,964 | 2/1941 | Strawn | 409/203 |
| 2,336,145 | 12/1943 | Wild | 51/289 R |
| 3,881,887 | 5/1975 | McMaster | 51/49 |

FOREIGN PATENT DOCUMENTS

| | | | |
|---|---|---|---|
| 305043 | 7/1971 | U.S.S.R. | 51/289 R |

*Primary Examiner*—Gary L. Smith

*Attorney, Agent, or Firm*—Allison C. Collard; Allison C. Collard; Thomas M. Galgano

[57] ABSTRACT

The invention provides a process and an apparatus for machining silicon rods and tubes by abrasion. The risk of fracture of such workpieces during grinding is prevented in this method and apparatus by the workpiece being held vertically in a cylindrical grinding machine in which the individual tools are uniformly arranged around the circumference of the workpiece in such a manner that their contact pressures are mutually substantially compensated.

2 Claims, 2 Drawing Figures

PROCESS FOR MACHINING SILICON RODS AND TUBES BY ABRASION

Figure 1:
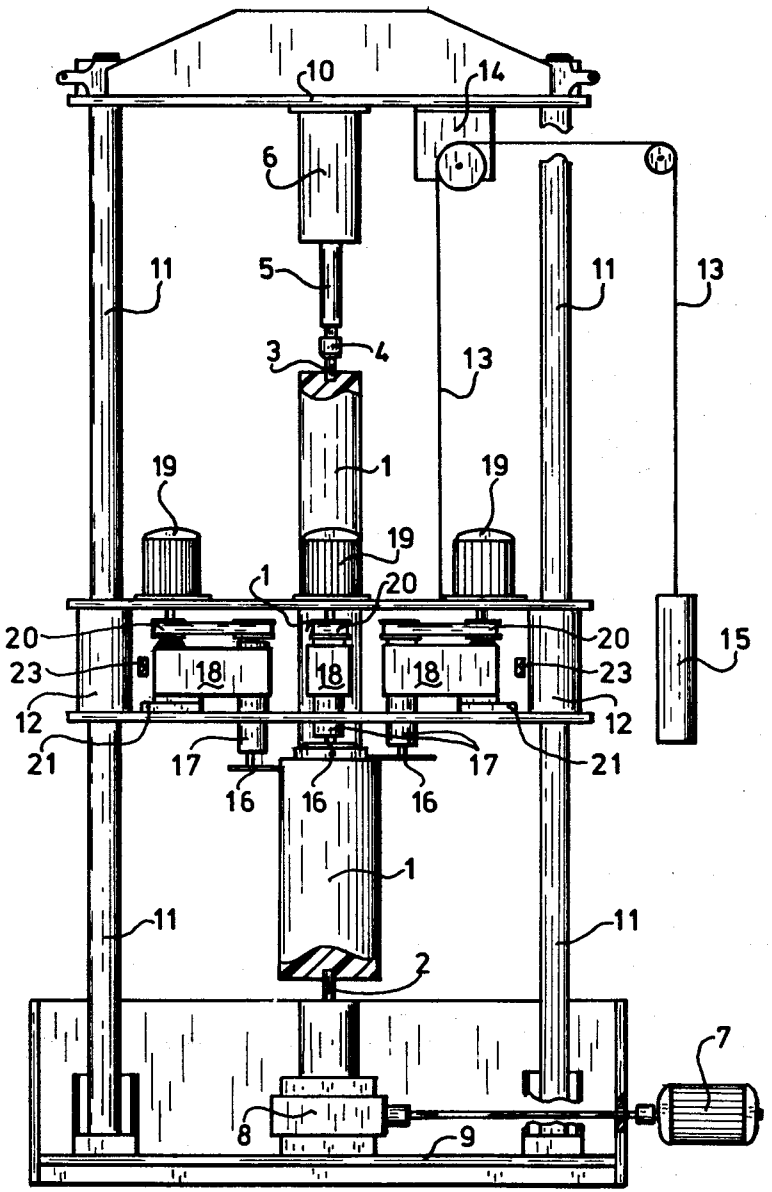

This invention relates to a process for machining silicon rods and tubes by abrasion, and to an apparatus for carrying out the process.

Silicon rods and tubes are usually produced by deposition from gaseous decomposable halosilanes, usually in admixture with hydrogen, on carriers heated to the deposition temperature. The polycrystalline silicon rods obtained are converted in a subsequent process into monocrystalline material by means of crucible-free zone melting. In this process, usually only absolutely straight rods having as smooth as possible a surface are used, which means that the polycrystalline rods produced by gaseous deposition with surfaces covered with innumerable pimples and wart-like projections, must first of all be subjected to cylindrical grinding. Even in the case of silicon tubes which are to be used as reaction chambers in high-temperature processes in the semiconductor field, especially in diffusion, oxidation and epitaxial processes, a smooth surface is usually required by the user.

There are usually relatively few problems in machining small silicon rods or tubes a few centimeters long in conventional cylindrical grinding machines. In the case of long rods having a length of, for example, 1 to 2 m or in particular, silicon tubes of this length having diameters of 10 to 20 cm and a wall thickness of approximately 0.5 to 1 cm, it is not possible to use such conventional machines in which the silicon member is clamped horizontally with or without the use of centers, and is ground smooth by means of one or two tools. The bending stress as a result of their weight is so great in the case of these silicon members that, owing to the inherent brittleness of the silicon, they, especially the tubes, frequently fracture, even simply when clamped.

The waste caused by fracture is still considerable even when using a back rest which moves along with the tool over the shaped silicon member, to support the silicon member in particular against the contact pressure of the tool. The problem underlying the present invention, therefore, is to find a process and an apparatus for the cylindrical grinding of silicon rods and tubes, in which the risk of fracture is minimized. This problem is solved by a process wherein the workpiece is held vertically and the contact pressures of the individual tools are mutually substantially compensated by a correspondingly uniform arrangement of the tools around the circumference of the workpiece.

This process is carried out by means of an apparatus which consists of a metal frame with holders for accommodating the workpiece, which holders are arranged one above the other in the cover plate and base plate, and with a vertically guided and movable tool carriage having the individual tools necessary for machining the workpiece. The tool carriage contains several, preferably approximately 3 to 7 motor-driven grinding tools, for example, grinding discs or turning chisels, which are attached in the horizontal plane, equidistant from the central point of the workpiece arrangement.

Particularly advantageous is an embodiment wherein the grinding discs of the individual tools are each attached to the head of a rocker arm, which can be pivoted in and out in the horizontal plane, and wherein all of the rocker arms are joined, by means of joints that are adjustable in length to a ring rotatable coaxially with the workpiece arrangement. By rotating this ring, it is possible to uniformly reduce or increase the contact pressure of all the individual tools on the workpiece.

Other objects and features of the present invention will become apparent from the following detailed description considered in connection with the accompanying drawings which disclose one embodiment of the invention. It is to be understood, however, that the drawing are designed for the purpose of illustration only, and not as a definition of the limits of the invention.

Figure 2:
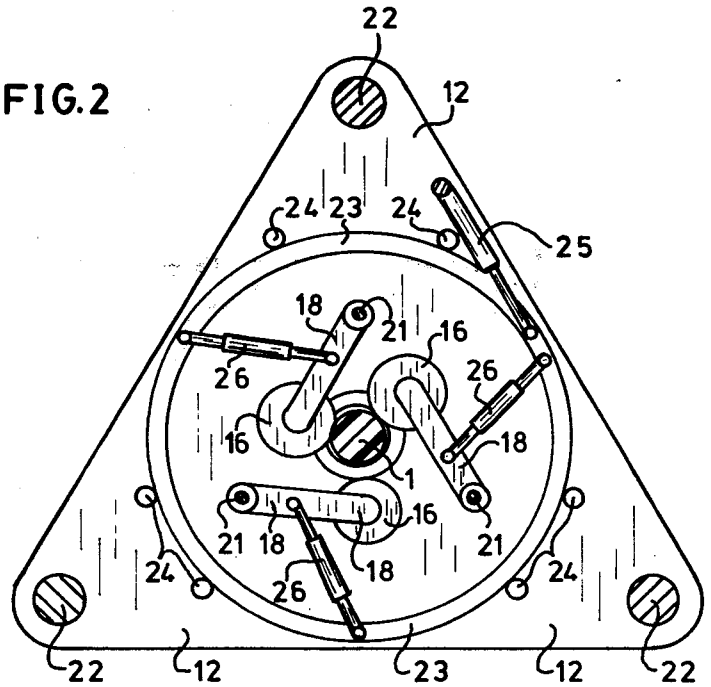

In the drawings, wherein similar reference characters denote similar elements throughout the several views:

FIG. 1 is a schematic side view illustration of a vertical cylindrical grinding machine, according to the present invention; and FIG. 2 is a schematic plan view of the tool carriage of the apparatus, according to the present invention.

Referring now in detail to the drawings, a silicon workpiece 1 to be machined, for example, a silicon rod, which has been provided at both ends with a concentric bore, is placed onto lower centering member 2, while an upper centering member 3 is fitted into the bore arranged concentrically at the upper end of silicon rod 1 by means of live center 4 in a piston rod 5 which, for example, can be moved hydraulically out of tension cylinder 6. The lower centering member 2 acts simultaneously as a drive member, that is, it can be rotated by means of electric motor 7 by way of gear 8, which movement is transmitted to the rod to be machined. Piston rod 5 is prevented from rotating at the same time by live center 4.

There are furthermore arranged between a base plate 9 and a cover plate 10 several guide columns 11, to which a tool carriage 12 is fixed exactly in the horizontal position, and which can be raised or lowered by means of a chain drive 13, by way of a geared motor 14 and a balancing weight 15.

The individual tools attached to the tool carriage comprise, for example, a grinding disc 16, which is attached by means of a spindle 17 in the head of a rocker arm 18 and which can be rotated by means of an electric motor 19 by way of, for example, a V-belt drive 20. At its other end, the rocker arm 18 is mounted on a support 21, arranged in the base plate of the tool carriage 12, it being possible for the rocker arm 18 to be pivoted in or out about this support, which functions as a pivot point for the rocker arm.

The operating mechanism of the individual tools is explained in detail with reference to FIG. 2. In the drawing, the tool carriage 12 is shown in plan view. The outer contour of the tool carriage is in the form of a triangle and corresponding bores 22 for receiving the guide columns 11 are provided in the three corners. A guide ring 23, which is exactly centered and guided by means of suitable guides 24, for example, rollers, is arranged inside the tool carriage 12. The guide ring can be rotated forwards or backwards through a few degrees by means of an adjusting cylinder 25. The rocker arms 18 of the individual tools are joined to the guide ring 23 by means of a lever 26. If the guide ring is moved, for example, clockwise, as a result of this movement, which is transmitted to the rocker arms, the grinding discs of all the individual tools are pivoted inwardly in a completely uniform manner. This ensures that the contact pressure of all the individual tools on the workpiece to be machined, is substantially, if not completely, the same. Since the grinding discs of the individual tools, which machine the workpiece in the vertical direction, are advantageously staggered slightly with respect to each other, causing wear of stepped formation to the workpiece, as can be seen in the drawings, the distance of the grinding discs from the axis of the workpiece differs slightly from tool to tool. Nevertheless, in order to ensure as uniform as possible a contact pressure of the individual tools on the workpiece, screw threads, for example, are arranged in levers 26, which join the rocker arms 18 of the individual tools to guide ring 23, by which threads the lever length of the individual tools may be differently adjusted at the beginning of the process, that is, coordinated with the depth of the step in the machining, so that by moving guide ring 23, a substantially uniform contact of the individual tools results on the workpiece. The contact of the individual tools on the workpiece is substantially compensated by the position of the individual tools. This is effected by so arranging the tools around the circumference of the workpiece that the free arcs of a circle that lie between the attachment points of each two tools, are substantially the same.

The grinding discs used are usually discs having an edging of boron carbide, silicon carbide, or preferably, diamond particles. Instead of such grinding discs, it is possible to use turning chisels. In this case, of course, the workpiece must be turned very quickly in order to achieve reasonable abrasion per unit of time. If it is tubes rather than rods that are being cylindrically ground, instead of the centering pins 2 and 3, corresponding supports or brackets must be used, by means of which the piece of tubing can be held in an accurately centered position and rotated. The rate of rotation of the tubes or rods when machining with grinding discs depends in each case on the shaped member to be machined, but lies between approximately 100 and 600 rev/min. The speed at which the tool carriage is moved with its individual tools from one end to the other while machining the workpiece, depends on the nature of the workpiece, on the abrasion intended, on the number of individual tools and not least on the speed of rotation of the workpiece itself.

It is therefore possible, in accordance with the invention, to grind cylindrically silicon rods and tubes without there being any risk of fracture.

Thus, while only one embodiment of the present invention has been shown and described, it will be obvious to those persons of ordinary skill in the art, thay many changes and modifications may be made thereunto without departing from the spirit and scope of the invention.

What is claimed is:

1. Apparatus for machining silicon rods and tubes by abrasion, comprising:

a metal frame having an upper cover plate and a lower base plate, and an upper and lower holder, disposed one above the other and secured, respectively, to said cover plate and said base plate, for accommodating a generally cylindrically silicon workpiece in a vertical orientation; and a vertically-movable tool carriage, supported on said frame, having a plurality of tools mounted thereon, for machining said workpiece, said tools being positioned on said carriage so as to be uniformly arranged about the circumference of said workpiece, so that the contact pressures of each tool are mutually substantially compensated, said tool carriage also having a ring rotatably mounted thereon which is coaxially disposed relative to said workpiece, a plurality of rocker arms each of which has a head end portion and a base end portion and which is pivotable about its base end portion for pivotable movement in a horizontal plane generally towards and away from the axis of the workpiece and a plurality of joints which are adjustable in length and which couple said rocker arms to said ring and wherein said tools each include a grinding disc which is attached to the head end portion of one of said rocker arms.

2. The apparatus according to claim 1, wherein said tool carriage has mounted thereon, 3 to 7 motor-driven grinding tools which, in a horizontal plane, are equidistantly spaced from the axis of the workpiece.

* * * * *

UNITED STATES PATENT AND TRADEMARK OFFICE

CERTIFICATE OF CORRECTION

PATENT NO. : 4,211,040

DATED : JULY 8, 1980

INVENTOR(S) : STEUDTEN ET AL

It is certified that error appears in the above—identified patent and that said Letters Patent is hereby corrected as shown below:

Column 4, line 6, "thay" should be --that--; line 17, "cylindrically" should be --cylindrical--.

Signed and Sealed this

*Second* Day of *December 1980*

[SEAL]

*Attest:*

SIDNEY A. DIAMOND

*Attesting Officer*

*Commissioner of Patents and Trademarks*